US011514832B2

(12) United States Patent
Kim et al.

(10) Patent No.: US 11,514,832 B2
(45) Date of Patent: Nov. 29, 2022

(54) DISPLAY APPARATUS AND METHOD OF DRIVING THE SAME

(71) Applicant: Samsung Display Co., Ltd., Yongin-si (KR)

(72) Inventors: Sooyeon Kim, Namyangju-si (KR); Taegon Im, Seongnam-si (KR); Jihyun Kim, Yongin-si (KR); Jiye Lee, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/374,893

(22) Filed: Jul. 13, 2021

(65) Prior Publication Data

US 2022/0093025 A1 Mar. 24, 2022

(30) Foreign Application Priority Data

Sep. 21, 2020 (KR) ..... 10-2020-0121508

(51) Int. Cl.
*G09G 3/20* (2006.01)

(52) U.S. Cl.
CPC ..... *G09G 3/20* (2013.01); *G09G 2310/0254* (2013.01); *G09G 2310/0275* (2013.01); *G09G 2310/0291* (2013.01); *G09G 2310/08* (2013.01); *G09G 2330/028* (2013.01)

(58) Field of Classification Search
CPC .. G09G 3/3648; G09G 3/3614; G09G 3/3677; G09G 2320/0233; G09G 2320/0247
See application file for complete search history.

(56) References Cited

U.S. PATENT DOCUMENTS

| | | | | |
|---|---|---|---|---|
| 8,441,473 | B2 | 5/2013 | Han et al. | |
| 9,159,282 | B2 | 10/2015 | Kim et al. | |
| 2008/0143665 | A1* | 6/2008 | Nishimura | G09G 3/3677 345/204 |
| 2010/0110046 | A1* | 5/2010 | Chen | G09G 3/3614 345/204 |
| 2010/0265274 | A1 | 10/2010 | Han et al. | |
| 2017/0287418 | A1* | 10/2017 | Hwang | G09G 3/3648 |

FOREIGN PATENT DOCUMENTS

| | | |
|---|---|---|
| KR | 10-0830123 | 5/2008 |
| KR | 10-0918698 | 9/2009 |
| KR | 10-1864834 | 6/2018 |

* cited by examiner

*Primary Examiner* — Gerald Johnson

(74) *Attorney, Agent, or Firm* — H.C. Park & Associates, PLC

(57) ABSTRACT

A display apparatus includes a display panel, a gamma reference voltage generator and a data driver. The gamma reference voltage generator is configured to generate a gamma reference voltage. The gamma reference voltage includes a gamma amplifier configured to output the gamma reference voltage. The data driver is configured to generate a data voltage based on the gamma reference voltage and to output the data voltage to the display panel. A polarity of an offset voltage of the gamma amplifier is inverted alternately in a unit of one frame and in a unit of two frames.

20 Claims, 16 Drawing Sheets

DISPLAY APPARATUS AND METHOD OF DRIVING THE SAME

CROSS REFERENCE TO RELATED APPLICATION

This application claims priority from and the benefit of Korean Patent Application No. 10-2020-0121508, filed on Sep. 21, 2020, which is hereby incorporated by reference for all purposes as if fully set forth herein.

BACKGROUND

Field

Exemplary embodiments/implementations of the invention relate generally to a display apparatus and a method of driving the display apparatus. More specifically, embodiments of the inventive concept relate to a display apparatus that effectively compensates an offset voltage of a gamma amplifier and a method of driving the display apparatus.

Discussion of the Background

Generally, a display apparatus includes a display panel and a display panel driver. The display panel includes a plurality of gate lines and a plurality of data lines. The display panel driver includes a gate driver, a data driver and a gamma reference voltage generator. The gate driver outputs gate signals to the gate lines. The data driver outputs data voltages to the data lines. The gamma reference voltage generator provides a gamma reference voltage to the data driver.

A gamma amplifier outputting the gamma reference voltage from the gamma reference voltage generator to the data driver has an offset value. When the offset value has positive values only or when the offset value has negative values only, an output voltage of the gamma amplifier may become different from a target voltage so that a display quality of the display panel may be deteriorated.

The above information disclosed in this Background section is only for understanding of the background of the inventive concepts, and, therefore, it may contain information that does not constitute prior art.

SUMMARY

One or more embodiments provide a display apparatus capable of effectively compensating an offset voltage of a gamma amplifier to enhance a display quality of a display panel.

One or more embodiments also provide a method of driving the display apparatus.

Additional features of the inventive concepts will be set forth in the description which follows, and in part will be apparent from the description, or may be learned by practice of the inventive concepts.

In an embodiment of a display apparatus according to an inventive concept, the display apparatus includes a display panel, a gamma reference voltage generator and a data driver. The gamma reference voltage generator is configured to generate a gamma reference voltage. The gamma reference voltage includes a gamma amplifier configured to output the gamma reference voltage. The data driver is configured to generate a data voltage based on the gamma reference voltage and to output the data voltage to the display panel. A polarity of an offset voltage of the gamma amplifier is inverted alternately in a unit of one frame and in a unit of two frames.

A polarity of the data voltage may be inverted in a unit of one frame.

The offset voltage of the gamma amplifier may have a first polarity in a first frame, a second polarity in a second frame, the second polarity in a third frame, the first polarity in a fourth frame, the second polarity in a fifth frame, the second polarity in a sixth frame and the first polarity in a seventh frame.

The offset voltage of the gamma amplifier may have a first polarity in a first frame, a second polarity in a second frame, the second polarity in a third frame, the first polarity in a fourth frame, the first polarity in a fifth frame, the second polarity in a sixth frame and the first polarity in a seventh frame.

One frame inversion of the polarity of the offset voltage and two frame inversion of the polarity of the offset voltage may be randomly performed over a plurality of frames.

One data line may be alternately connected to pixels disposed in two pixel columns in the display panel.

The polarity of the offset voltage of the gamma amplifier may be inverted in a unit of two horizontal lines and the polarity of the offset voltage of the gamma amplifier is inverted alternately in a unit of one frame and in a unit of two frames.

The polarity of the offset voltage of the gamma amplifier may be inverted in a unit of two horizontal lines and the offset voltage of the gamma amplifier may have a first polarity in a first frame, a second polarity in a second frame, the second polarity in a third frame, the first polarity in a fourth frame, the first polarity in a fifth frame, the second polarity in a sixth frame and the first polarity in a seventh frame.

One data line may be connected to pixels disposed in one pixel column in the display panel.

The polarity of the offset voltage of the gamma amplifier may be inverted in a unit of two horizontal lines and the polarity of the offset voltage of the gamma amplifier may be inverted alternately in a unit of one frame and in a unit of two frames.

The polarity of the offset voltage of the gamma amplifier may be inverted in a unit of two horizontal lines and the offset voltage of the gamma amplifier may have a first polarity in a first frame, a second polarity in a second frame, the second polarity in a third frame, the first polarity in a fourth frame, the first polarity in a fifth frame, the second polarity in a sixth frame and the first polarity in a seventh frame.

The polarity of the offset voltage of the gamma amplifier may be inverted in a unit of one horizontal line and the polarity of the offset voltage of the gamma amplifier may be inverted alternately in a unit of one frame and in a unit of two frames.

The polarity of the offset voltage of the gamma amplifier may be inverted in a unit of one horizontal line and the offset voltage of the gamma amplifier may have a first polarity in a first frame, a second polarity in a second frame, the second polarity in a third frame, the first polarity in a fourth frame, the first polarity in a fifth frame, the second polarity in a sixth frame and the first polarity in a seventh frame.

One data line may be alternately connected to pixels disposed in four pixel columns in the display panel.

The polarity of the offset voltage of the gamma amplifier may be inverted in a unit of four horizontal lines and the polarity of the offset voltage of the gamma amplifier is inverted alternately in a unit of one frame and in a unit of two frames.

The polarity of the offset voltage of the gamma amplifier may be inverted in a unit of four horizontal lines and the offset voltage of the gamma amplifier may have a first polarity in a first frame, a second polarity in a second frame, the second polarity in a third frame, the first polarity in a fourth frame, the first polarity in a fifth frame, the second polarity in a sixth frame and the first polarity in a seventh frame.

In an embodiment of a method of driving a display apparatus according to an inventive concept, the method includes generating a gamma reference voltage, outputting the gamma reference voltage to a data driver using a gamma amplifier, generating a data voltage based on the gamma reference voltage and outputting the data voltage to a display panel. A polarity of an offset voltage of the gamma amplifier is inverted alternately in a unit of one frame and in a unit of two frames.

A polarity of the data voltage may be inverted in a unit of one frame.

The offset voltage of the gamma amplifier may have a first polarity in a first frame, a second polarity in a second frame, the second polarity in a third frame, the first polarity in a fourth frame, the second polarity in a fifth frame, the second polarity in a sixth frame and the first polarity in a seventh frame.

The offset voltage of the gamma amplifier may have a first polarity in a first frame, a second polarity in a second frame, the second polarity in a third frame, the first polarity in a fourth frame, the first polarity in a fifth frame, the second polarity in a sixth frame and the first polarity in a seventh frame.

According to the display apparatus and the method of driving the display apparatus, the polarity of the offset voltage of the gamma amplifier may be inverted alternately in a unit of one frame and in a unit of two frames. Thus, no offset voltage cancelation problem occurs in a temporal manner when the polarity of the offset voltage of the gamma amplifier is inverted in a unit of one frame, and no flicker problem is generated in a displayed image when the polarity of the offset voltage of the gamma amplifier is inverted in a unit of two frames.

In addition, the polarity of the offset voltage of the gamma amplifier is inverted in a unit of two horizontal lines in a pixel structure including a data line alternately connected to pixels disposed in two pixel columns so that the offset voltage of the gamma amplifier may be spatially compensated.

In addition, the polarity of the offset voltage of the gamma amplifier is inverted in a unit of a horizontal line or in a unit of two horizontal lines in a pixel structure including a data line connected to pixels disposed in a pixel column so that the offset voltage of the gamma amplifier may be spatially compensated.

In addition, the polarity of the offset voltage of the gamma amplifier is inverted in a unit of four horizontal lines in a pixel structure including a data line connected to pixels disposed in four pixel columns so that the offset voltage of the gamma amplifier may be spatially compensated.

The offset voltage of the gamma amplifier may be temporally and spatially compensated properly so that the display quality of the display panel may be enhanced.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
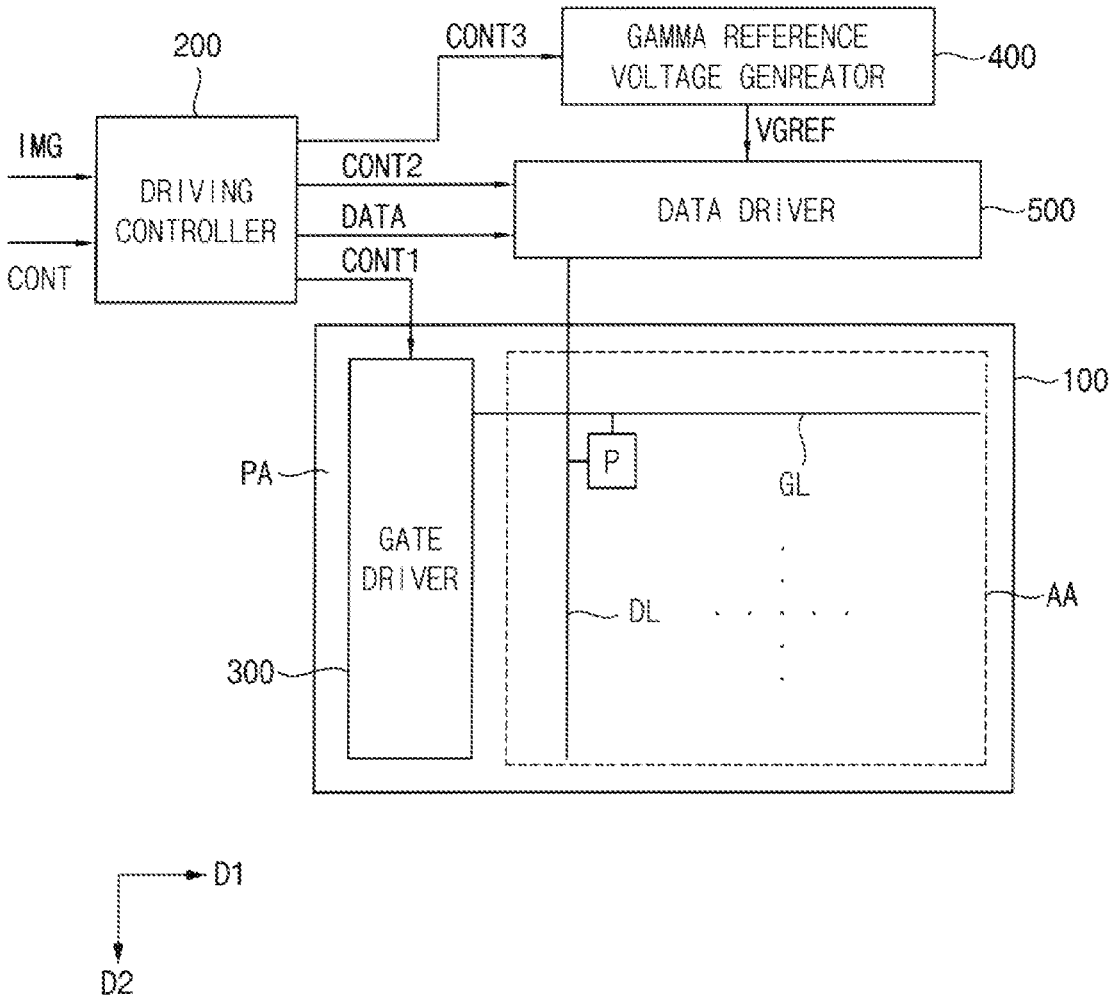
FIG. 1 is a block diagram illustrating a display apparatus according to an embodiment that is constructed according to principles of the invention.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As is customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Hereinafter, various embodiments will be explained in detail with reference to the accompanying drawings.

FIG. 1 is a block diagram illustrating a display apparatus according to an embodiment that is constructed according to principles of the invention.

Referring to FIG. 1, the display apparatus includes a display panel 100 and a display panel driver. The display panel driver includes a driving controller 200, a gate driver 300, a gamma reference voltage generator 400, and a data driver 500.

For example, the driving controller 200 and the data driver 500 may be integrally formed. For example, the driving controller 200, the gamma reference voltage generator 400 and the data driver 500 may be integrally formed. A driving module including at least the driving controller 200 and the data driver 500 that are integrally formed may correspond to a timing controller embedded data driver (TED).

The display panel 100 has a display region AA on which an image is displayed and a peripheral region PA adjacent to the display region AA, in which the peripheral region PA is a region in which an image is not displayed.

The display panel 100 includes a plurality of gate lines GL, a plurality of data lines DL and a plurality of pixels P connected to the gate lines GL and the data lines DL. The gate lines GL extend in a first direction D1 and the data lines DL extend in a second direction D2 substantially orthogonal to the first direction D1.

The driving controller 200 receives input image data IMG and an input control signal CONT from an external apparatus. The input image data IMG may include red image data, green image data and blue image data (i.e., RGB image data). The input image data IMG may include white image data. The input image data IMG may include cyan image data, magenta image data, and yellow image data (i.e., CMY image data). The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the driving controller 200. The gate driver 300 outputs the gate signals to the gate lines GL. For example, the gate driver 300 may sequentially output the gate signals to the gate lines GL.

In the embodiment described herein, the gate driver 300 may be integrated on the peripheral region PA of the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an embodiment, the gamma reference voltage generator 400 may be disposed in the driving controller 200, or in the data driver 500. For example, the gamma reference voltage generator 400 and the data driver 500 may be integrally formed.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

Figure 2:
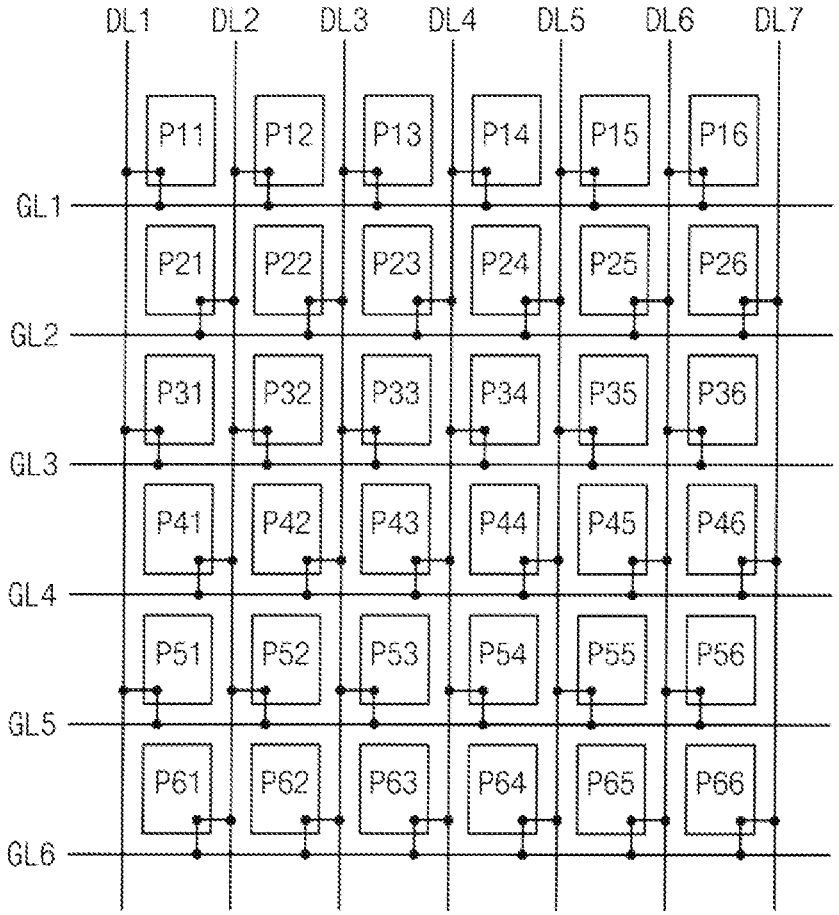
FIG. 2 is a conceptual diagram illustrating a display panel of FIG. 1.

FIG. 2 is a conceptual diagram illustrating the display panel 100 of FIG. 1.

Referring to FIGS. 1 and 2, one data line may be alternately connected to the pixels in two pixel columns in the display panel 100. In addition, the pixels in one pixel column may be connected to two data lines adjacent to the pixel column in the display panel 100.

For example, a second data line DL2 may be alternately connected to pixels P21, P41 and P61 in a first pixel column and pixels P12, P32 and P52 in a second pixel column. For example, a third data line DL3 may be alternately connected to pixels P22, P42 and P62 in the second pixel column and pixels P13, P33 and P53 in a third pixel column. For example, a fourth data line DL4 may be alternately connected to pixels P23, P43 and P63 in the third pixel column and pixels P14, P34 and P54 in a fourth pixel column. For example, a fifth data line DL5 may be alternately connected to pixels P24, P44 and P64 in the fourth pixel column and pixels P15, P35 and P55 in a fifth pixel column. For example, a sixth data line DL6 may be alternately connected to pixels P25, P45 and P65 in the fifth pixel column and pixels P16, P36 and P56 in a sixth pixel column. For example, a first data line DL1 may be connected to pixels P11, P31 and P51 in the first pixel column. For example, a seventh data line DL7 may be connected to pixels P26, P46 and P66 in the sixth pixel column.

For example, the pixels P11, P21, P31, P41, P51 and P61 in the first pixel column may be alternately connected to the first data line DL1 and the second data line DL2. For example, the pixels P12, P22, P32, P42, P52 and P62 in the second pixel column may be alternately connected to the second data line DL2 and the third date line DL3. For example, the pixels P13, P23, P33, P43, P53 and P63 in the third pixel column may be alternately connected to the third data line DL3 and the fourth date line DL4.

One gate line may be connected to the pixels in one pixel row in the display panel 100. For example, pixels P11 to P16 in a first pixel row may be connected to a first gate line GL1. For example, pixels P21 to P26 in a second pixel row may be connected to a second gate line GL2. For example, pixels P31 to P36 in a third pixel row may be connected to a third gate line GL3. For example, pixels P41 to P46 in a fourth pixel row may be connected to a fourth gate line GL4. For example, pixels P51 to P56 in a fifth pixel row may be connected to a fifth gate line GL5. For example, pixels P61 to P66 in a sixth pixel row may be connected to a sixth gate line GL6.

Data voltages applied to adjacent data lines may have opposite polarities. In addition, the polarities of the data voltages applied to the data lines may be inverted in a unit of a frame. For example, positive data voltages may be applied to the first, third, fifth and seventh data lines DL1, DL3, DL5 and DL7 in a first frame. For example, negative data voltages may be applied to the second, fourth and sixth data lines DL2, DL4 and DL6 in the first frame. For example, negative data voltages may be applied to the first, third, fifth and seventh data lines DL1, DL3, DL5 and DL7 in a second frame. For example, positive data voltages may be applied to the second, fourth and sixth data lines DL2, DL4 and DL6 in the second frame.

Accordingly, the data voltages applied to the pixels of the display panel 100 may be inverted in every dot (every pixel) in a row direction and in a column direction.

For example, the pixels in the first pixel column may be red (R) pixels, the pixels in the second pixel column may be green (G) pixels and the pixels in the third pixel column may be blue (B) pixels. For example, the pixels in the fourth pixel column may be red (R) pixels, the pixels in the fifth pixel column may be green (G) pixels and the pixels in the sixth pixel column may be blue (B) pixels.

Figure 3:
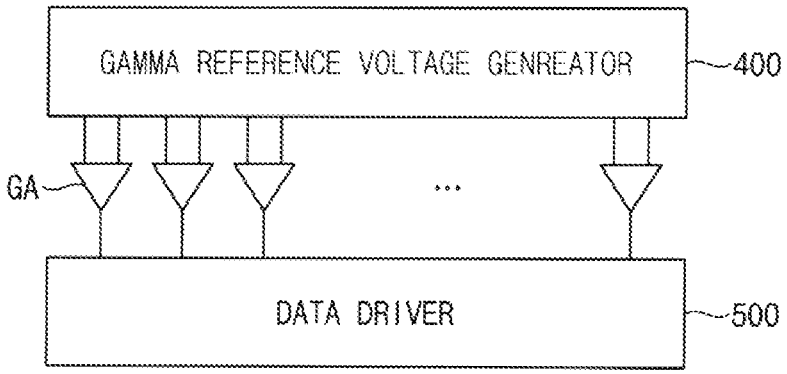
FIG. 3 is a conceptual diagram illustrating a gamma amplifier outputting a gamma reference voltage from a gamma reference voltage generator of FIG. 1 to a data driver of FIG. 1.
Figure 4:
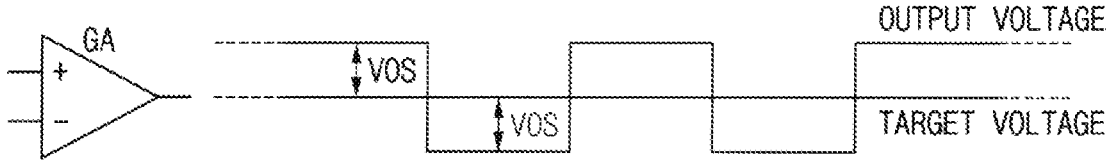
FIG. 4 is a conceptual diagram illustrating an output voltage of the gamma amplifier of FIG. 3 when an offset voltage of the gamma amplifier of FIG. 3 is compensated.
Figure 5:
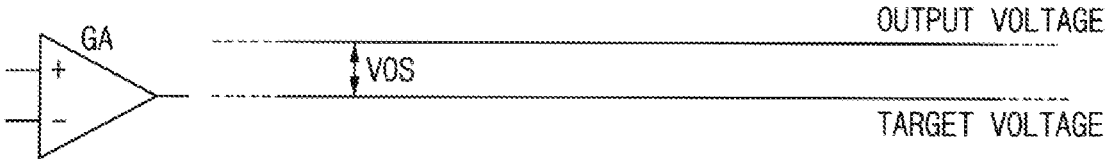
FIG. 5 is a conceptual diagram illustrating an output voltage of the gamma amplifier of FIG. 3 when the offset voltage of the gamma amplifier of FIG. 3 is not compensated.

FIG. 3 is a conceptual diagram illustrating a gamma amplifier GA outputting the gamma reference voltage VGREF from the gamma reference voltage generator 400 of FIG. 1 to the data driver 500 of FIG. 1. FIG. 4 is a conceptual diagram illustrating an output voltage of the gamma amplifier GA of FIG. 3 when an offset voltage VOS of the gamma amplifier GA of FIG. 3 is compensated. FIG. 5 is a conceptual diagram illustrating an output voltage of the gamma amplifier GA of FIG. 3 when the offset voltage VOS of the gamma amplifier GA of FIG. 3 is not compensated.

Referring to FIGS. 1 to 5, the gamma reference voltage generator 400 may include a plurality of gamma amplifiers GA outputting the gamma reference voltage VGREF to the data driver 500.

The gamma amplifier GA may have a positive offset voltage +VOS and a negative offset voltage −VOS. When the gamma reference voltage VGREF is applied to a positive terminal of the gamma amplifier GA, the positive offset voltage +VOS may be applied to the gamma reference voltage VGREF. When the positive offset voltage +VOS is applied to the gamma reference voltage VGREF, the output voltage of the gamma amplifier GA may be greater than a target voltage by the offset voltage VOS. In contrast, when the gamma reference voltage VGREF is applied to a negative terminal of the gamma amplifier GA, the negative offset voltage −VOS may be applied to the gamma reference voltage VGREF. When the negative offset voltage −VOS is applied to the gamma reference voltage VGREF, the output voltage of the gamma amplifier GA may be less than the target voltage by the offset voltage VOS.

In FIG. 4, the polarity of the offset voltage of the gamma amplifier GA may be periodically inverted. Thus, the positive offset voltage +VOS and the negative offset voltage −VOS cancel each other in the output voltage so that the output voltage may have the target voltage on average.

In FIG. 5, the polarity of the offset voltage of the gamma amplifier GA may not be inverted and the offset voltage of the gamma amplifier GA may maintain a single value (e.g. the positive offset voltage +VOS). Thus, the positive offset voltage +VOS and the negative offset voltage −VOS does not cancel each other in the output voltage so that the output voltage may be greater than the target voltage by the offset voltage +VOS on average. When the output voltage is greater than the target voltage, the data voltage outputted from the data driver 500 may also have a level different from a target data voltage. Accordingly, the display panel 100 does not display a desired target luminance so that the display quality of the display panel 100 may be deteriorated.

Figure 6:
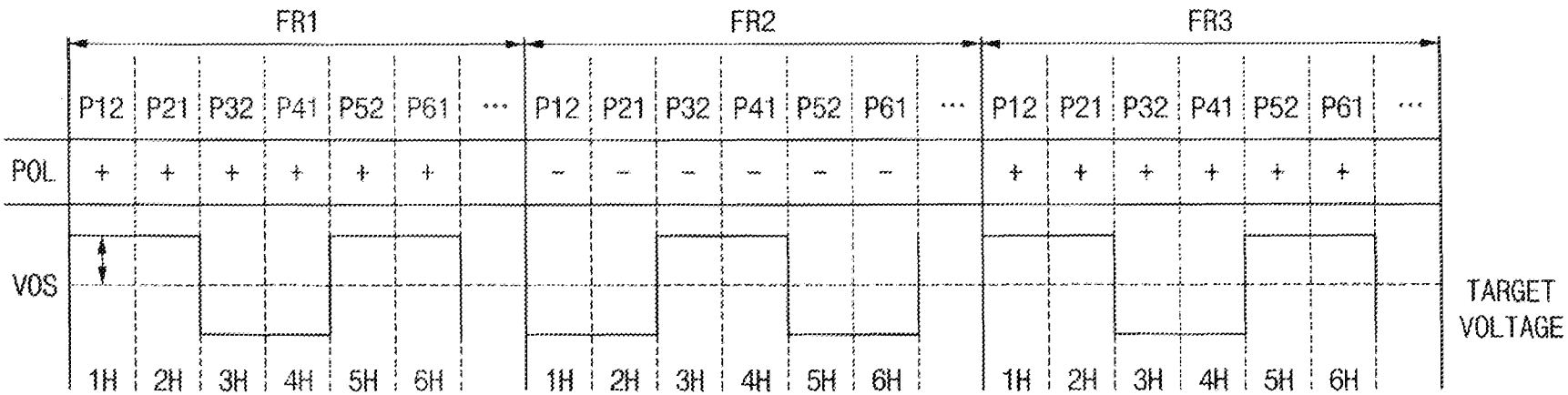
FIG. 6 is a conceptual diagram illustrating an output voltage of the gamma amplifier of FIG. 3 when a polarity of the offset voltage of the gamma amplifier of FIG. 3 is inverted in a unit of a frame and in a unit of two horizontal lines.

FIG. 6 is a conceptual diagram illustrating an output voltage of the gamma amplifier GA of FIG. 3 when a polarity of the offset voltage VOS of the gamma amplifier GA of FIG. 3 is inverted in a unit of a frame and in a unit of two horizontal lines.

In FIG. 6, the polarity of the data voltage and the polarity of the offset voltage VOS of the gamma amplifier GA may be illustrated based on the data voltage output to the second data line DL2 of FIG. 2. For example, in FIG. 6, the polarity POL of the data voltage applied to the second data line DL2 in a first frame FR1 and a third frame FR3 may be positive +. For example, in FIG. 6, the polarity POL of the data voltage applied to the second data line DL2 in a second frame FR2 may be negative −.

In FIG. 2, the data voltage applied to the second data line DL2 in a first horizontal line period 1H of the first frame FR1 may be applied to the pixel of P12, the data voltage applied to the second data line DL2 in a second horizontal line period 2H of the first frame FR1 may be applied to the pixel of P21, the data voltage applied to the second data line DL2 in a third horizontal line period 3H of the first frame FR1 may be applied to the pixel of P32, the data voltage applied to the second data line DL2 in a fourth horizontal line period 4H of the first frame FR1 may be applied to the pixel of P41, the data voltage applied to the second data line DL2 in a fifth horizontal line period 5H of the first frame FR1 may be applied to the pixel of P52 and the data voltage applied to the second data line DL2 in a sixth horizontal line period 6H of the first frame FR1 may be applied to the pixel of P61.

The offset voltage VOS applied to the gamma amplifier GA are inverted in a unit of two horizontal lines so that the positive offset voltage +VOS applied to the pixel of P12 in the first horizontal line period 1H of the first frame FR1 may be canceled by the negative offset voltage −VOS applied to the pixel of P32 in the third horizontal line period 3H of the first frame FR1. This offset voltage cancelation is operated in the same frame FR1 so that the offset voltage cancelation may be referred as a spatial offset cancelation. Similarly, the positive offset voltage +VOS applied to the pixel of P21 in the second horizontal line period 2H of the first frame FR1 may be canceled by the negative offset voltage −VOS applied to the pixel of P41 in the fourth horizontal line period 4H of the first frame FR1.

When the offset voltage VOS of the gamma amplifier GA is inverted in a unit of one horizontal line, the positive offset voltage +VOS applied to the pixel of P12 in the first horizontal line period 1H of the first frame FR1 may be canceled by the negative offset voltage −VOS applied to the pixel of P21 in the second horizontal line period 2H of the first frame FR1. However, in this case, the pixel of P12 is disposed in the first pixel column representing a first color (e.g. red) and the pixel of P21 is disposed in the second pixel column representing a second color (e.g. green) so that the offset voltage cancelation of different colors may not be visually effective.

In addition, when the offset voltage VOS of the gamma amplifier GA is inverted in a unit of one horizontal line, the positive offset voltage +VOS is applied to the pixel of P12 in the first horizontal line period 1H of the first frame FR1 and the positive offset voltage +VOS is applied to the pixel of P32 in the third horizontal line period 3H of the first frame FR1 so that the positive offset voltage +VOS applied to the pixel of P12 in the first frame FR1 and the positive offset voltage +VOS applied to the pixel of P32 in the first frame FR1 may not be canceled with each other.

Thus, in the embodiment described herein, it is appropriate that the offset voltage VOS of the gamma amplifier GA is compensated in a unit of two horizontal lines as explained above.

In the embodiment, for example, the polarity of the offset voltage VOS of the gamma amplifier GA may be inverted in a unit of one frame.

The polarity of the data voltage applied to the pixel of P12 in the first horizontal line period 1H of the first frame FR1 may be positive + and the polarity of the offset voltage VOS of the gamma amplifier GA applied to the pixel of P12 in the first horizontal line period 1H of the first frame FR1 may be positive +VOS. The polarity of the data voltage applied to the pixel of P12 in the first horizontal line period 1H of the second frame FR2 may be negative − and the polarity of the offset voltage VOS of the gamma amplifier GA applied to the pixel of P12 in the first horizontal line period 1H of the first frame FR1 may be negative −VOS. The polarity of the data voltage applied to the pixel of P12 in the first horizontal line period 1H of the third frame FR3 may be positive + and the polarity of the offset voltage VOS of the gamma amplifier GA applied to the pixel of P12 in the first horizontal line period 1H of the third frame FR3 may be positive +VOS.

Compensation of the offset voltage VOS of the gamma amplifier GA may be effective when the polarities of the data voltages are the same. Thus, when the polarity of the data voltage is inverted in a unit of one frame and the polarity of the offset voltage VOS of the gamma amplifier GA is inverted in a unit of one frame, the polarity of the data voltage applied to the pixel of P12 in the first horizontal line period 1H of the first frame FR1 may be positive + and the polarity of the offset voltage VOS of the gamma amplifier GA applied to the pixel of P12 in the first horizontal line period 1H of the first frame FR1 may be positive +VOS and the polarity of the data voltage applied to the pixel of P12 in the first horizontal line period 1H of the third frame FR3 may be positive + and the polarity of the offset voltage VOS of the gamma amplifier GA applied to the pixel of P12 in the first horizontal line period 1H of the third frame FR3 may be positive +VOS. Thus, the temporal cancelation of the offset voltage VOS of the gamma amplifier GA for the pixel of P12 may not be performed between the first frame FR1 when the data voltage has the positive polarity and the third frame FR3 when the data voltage has the positive polarity.

Figure 7:
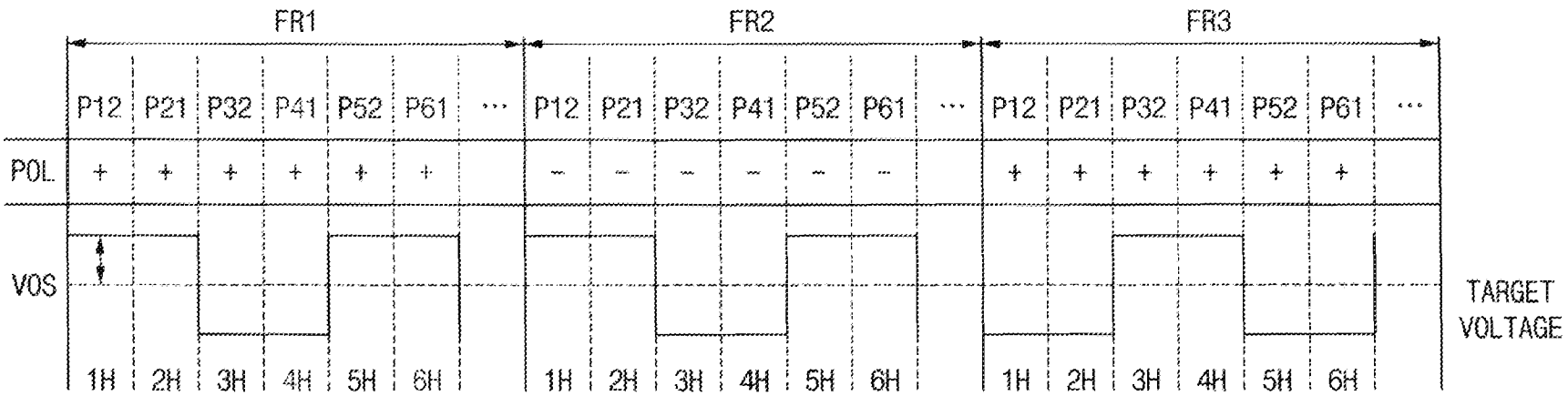
FIG. 7 is a conceptual diagram illustrating an output voltage of the gamma amplifier of FIG. 3 when a polarity of the offset voltage of the gamma amplifier of FIG. 3 is inverted in a unit of two frames and in a unit of two horizontal lines.

FIG. 7 is a conceptual diagram illustrating an output voltage of the gamma amplifier of FIG. 3 when a polarity of the offset voltage of the gamma amplifier of FIG. 3 is inverted in a unit of two frames and in a unit of two horizontal lines.

As explained referring to FIG. 6, when the offset voltage VOS of the gamma amplifier GA is inverted in a unit of two horizontal lines, the positive offset voltage +VOS of the pixel of P12 may be properly canceled by the negative offset voltage −VOS of the pixel of P32.

In FIG. 6, the polarity of the data voltage is inverted in a unit of one frame and the polarity of the offset voltage VOS of the gamma amplifier GA is inverted in a unit of one frame so that the temporal cancelation of the offset voltage VOS of the gamma amplifier GA may not be performed between the first frame FR1 when the data voltage has the positive polarity and the third frame FR3 when the data voltage has the positive polarity.

However, in FIG. 7, the polarity of the data voltage is inverted in a unit of one frame and the polarity of the offset voltage VOS of the gamma amplifier GA is inverted in a unit of two frames so that the temporal cancelation of the offset voltage VOS of the gamma amplifier GA may be properly performed between the first frame FR1 when the data voltage has the positive polarity and the third frame FR3 when the data voltage has the positive polarity.

In FIG. 7, for example, the polarity of the data voltage applied to the pixel of P12 in the first horizontal line period 1H of the first frame FR1 may be positive + and the polarity of the offset voltage VOS of the gamma amplifier GA applied to the pixel of P12 in the first horizontal line period 1H of the first frame FR1 may be positive +VOS and the polarity of the data voltage applied to the pixel of P12 in the first horizontal line period 1H of the third frame FR3 may be positive + and the polarity of the offset voltage VOS of the gamma amplifier GA applied to the pixel of P12 in the first horizontal line period 1H of the third frame FR3 may be negative −VOS. Thus, the temporal cancelation of the offset voltage VOS of the gamma amplifier GA may be performed between the first frame FR1 when the data voltage has the positive polarity and the third frame FR3 when the data voltage has the positive polarity.

However, when the polarity of the data voltage is inverted in a unit of two frames, the driving frequency of the display panel 100 may be reduced by half in a view of the gamma reference voltage VGREF. When the polarity of the data voltage is inverted in a unit of two frames and the display panel 100 maintains the same image, a flicker effect may be shown to a user in a display region due to the reduced driving frequency.

Figure 8:
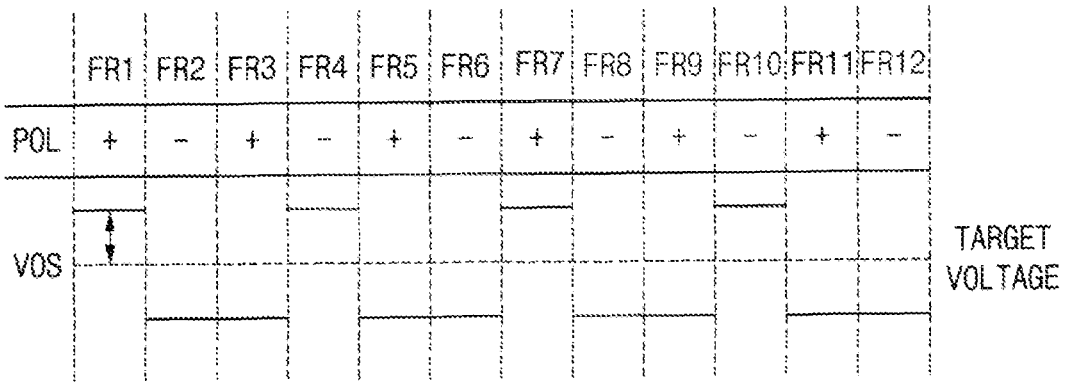
FIG. 8 is a conceptual diagram illustrating an output voltage of the gamma amplifier of FIG. 3 when a polarity of the offset voltage of the gamma amplifier of FIG. 3 is inverted in a unit of one frame, two frames, one frame and two frames sequentially.

FIG. 8 is a conceptual diagram illustrating an output voltage of the gamma amplifier GA of FIG. 3 when a polarity of the offset voltage VOS of the gamma amplifier GA of FIG. 3 is inverted in a unit of one frame, two frames, one frame and two frames sequentially.

Referring to FIGS. 1 to 8, in an embodiment, the inversion of the polarity of the offset voltage VOS of the gamma amplifier GA in a unit of one frame and the inversion of the polarity of the offset voltage VOS of the gamma amplifier GA in a unit of two frames may be alternately performed.

In FIG. 8, the polarity of the data voltage is inverted in a unit of one frame so that the polarities of the data voltage in first to sixth frames FR1 to FR6 may be sequentially +, +, + and −.

The polarity of the offset voltage VOS of the gamma amplifier GA may be inverted in a unit of one frame from a first frame FR1 to a second frame FR2, may be inverted in a unit of two frames from the second frame FR2 to a fourth frame FR4, may be inverted in a unit of one frame from the fourth frame FR4 to a fifth frame FR5 and may be inverted in a unit of two frames from the fifth frame FR5 to a seventh frame FR7. Thus, the polarities of the offset voltage VOS of the gamma amplifier GA in first to sixth frames FR1 to FR6 may be sequentially +, −, −, +, − and −. The polarities of the offset voltage VOS of the gamma amplifier GA in seventh to twelfth frames FR7 to FR12 may be also sequentially +, −, −, +, − and −.

The polarities of the offset voltage VOS of the gamma amplifier GA may be sequentially +, − and − in the first, third and fifth frames FR1, FR3 and FR5 when the data voltage has the positive polarity. The polarities of the offset voltage VOS of the gamma amplifier GA may be sequentially −, + and − in the second, fourth and sixth frames FR2, FR4 and FR6 when the data voltage has the negative polarity.

According to the embodiment described herein, the polarity of the offset voltage VOS of the gamma amplifier GA may be inverted alternately in a unit of one frame and in a unit of two frames. Thus, no offset voltage cancelation problem occurs in a temporal manner generated when the polarity of the offset voltage VOS of the gamma amplifier GA is inverted in a unit of one frame, and no flicker problem is generated in a displayed image when the polarity of the offset voltage of the gamma amplifier is inverted in a unit of two frames.

In addition, the polarity of the offset voltage VOS of the gamma amplifier GA is inverted in a unit of two horizontal lines in a pixel structure including a data line alternately connected to pixels disposed in two pixel columns so that the offset voltage VOS of the gamma amplifier GA may be spatially compensated.

The offset voltage of the gamma amplifier may be temporally and spatially compensated properly so that the display quality of the display panel 100 may be enhanced.

Figure 9:
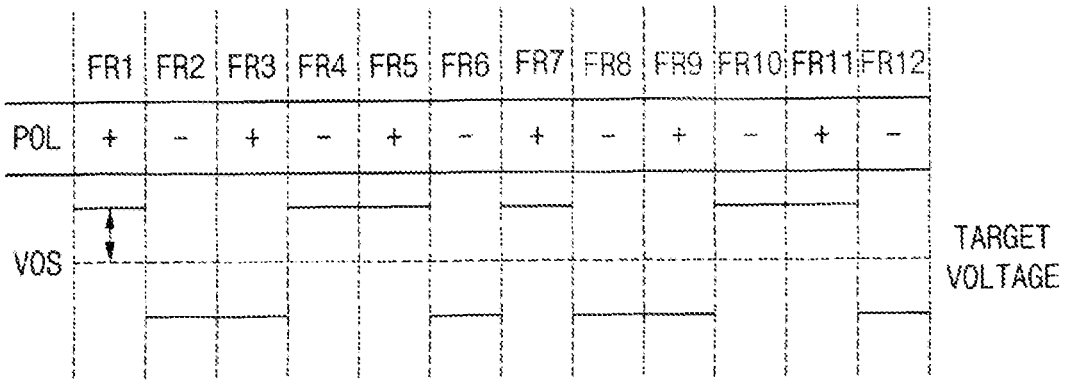
FIG. 9 is a conceptual diagram illustrating an output voltage of a gamma amplifier of a display apparatus according to an embodiment when a polarity of an offset voltage of the gamma amplifier is inverted in a unit of one frame, two frames, two frames and one frame sequentially.

FIG. 9 is a conceptual diagram illustrating an output voltage of a gamma amplifier GA of a display apparatus according to an embodiment when a polarity of an offset voltage VOS of the gamma amplifier GA is inverted in a unit of one frame, two frames, two frames and one frame sequentially.

The display apparatus and the method of the display apparatus according to an embodiment is substantially the same as the display apparatus and the method of the display apparatus of an embodiment explained referring to FIGS. 1 to 8 except for an inversion sequence pattern of the offset voltage VOS of the gamma amplifier GA. Thus, the same reference numerals will be used to refer to the same or like parts as those described in the previous embodiment of FIGS. 1 to 8 and any repetitive explanation concerning the above elements will be omitted for ease in explanation of this embodiment.

Referring to FIGS. 1 to 7 and 9, in an embodiment, the inversion of the polarity of the offset voltage VOS of the gamma amplifier GA in a unit of one frame and the inversion of the polarity of the offset voltage VOS of the gamma amplifier GA in a unit of two frames may be alternately performed.

In FIG. 9, the polarity of the data voltage is inverted in a unit of one frame so that the polarities of the data voltage in first to sixth frames FR1 to FR6 may be sequentially +, −+, −, + and −.

The polarity of the offset voltage VOS of the gamma amplifier GA may be inverted in a unit of one frame from a first frame FR1 to a second frame FR2, may be inverted in a unit of two frames from the second frame FR2 to a fourth frame FR4, may be inverted in a unit of two frames from the fourth frame FR4 to a sixth frame FR6 and may be inverted in a unit of one frame from the sixth frame FR6 to a seventh frame FR7. Thus, the polarities of the offset voltage VOS of the gamma amplifier GA in first to sixth frames FR1 to FR6 may be sequentially +, −, −, +, + and −. The polarities of the offset voltage VOS of the gamma amplifier GA in seventh to twelfth frames FR7 to FR12 may be also sequentially +, −. −, +, + and −.

The polarities of the offset voltage VOS of the gamma amplifier GA may be sequentially +, − and + in the first, third and fifth frames FR1, FR3 and FR5 when the data voltage has the positive polarity. The polarities of the offset voltage VOS of the gamma amplifier GA may be sequentially −, + and − in the second, fourth and sixth frames FR2, FR4 and FR6 when the data voltage has the negative polarity.

As explained above, the one frame inversion of the polarity of the offset voltage VOS, the two frame inversion of the polarity of the offset voltage VOS, the one frame inversion of the polarity of the offset voltage VOS and the two frame inversion of the polarity of the offset voltage VOS are sequentially performed in FIG. 8. The one frame inversion of the polarity of the offset voltage VOS, the two frame inversion of the polarity of the offset voltage VOS, the two frame inversion of the polarity of the offset voltage VOS and the one frame inversion of the polarity of the offset voltage VOS are sequentially performed in FIG. 9. In an embodiment, the one frame inversion of the polarity of the offset voltage VOS and the two frame inversion of the polarity of the offset voltage VOS may be randomly performed.

According to the embodiment described herein, the polarity of the offset voltage VOS of the gamma amplifier GA may be inverted alternately in a unit of one frame and in a unit of two frames. Thus, no offset voltage cancelation problem occurs in a temporal manner when the polarity of the offset voltage VOS of the gamma amplifier GA is inverted in a unit of one frame, and no flicker problem is generated in a displayed image when the polarity of the offset voltage of the gamma amplifier is inverted in a unit of two frames.

In addition, the polarity of the offset voltage VOS of the gamma amplifier GA is inverted in a unit of two horizontal lines in a pixel structure including one data line alternately connected to pixels disposed in two pixel columns so that the offset voltage VOS of the gamma amplifier GA may be spatially compensated.

The offset voltage of the gamma amplifier may be temporally and spatially compensated properly so that the display quality of the display panel 100 may be enhanced.

Figure 10:
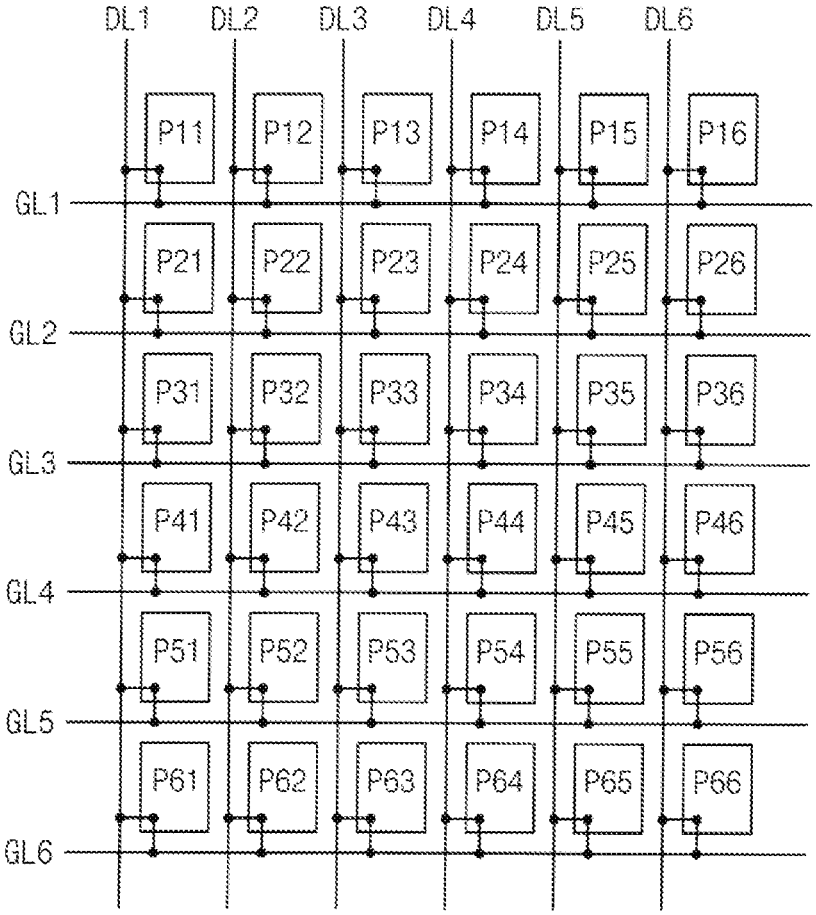
FIG. 10 is a conceptual diagram illustrating a display panel of a display apparatus according to an embodiment.
Figure 11:
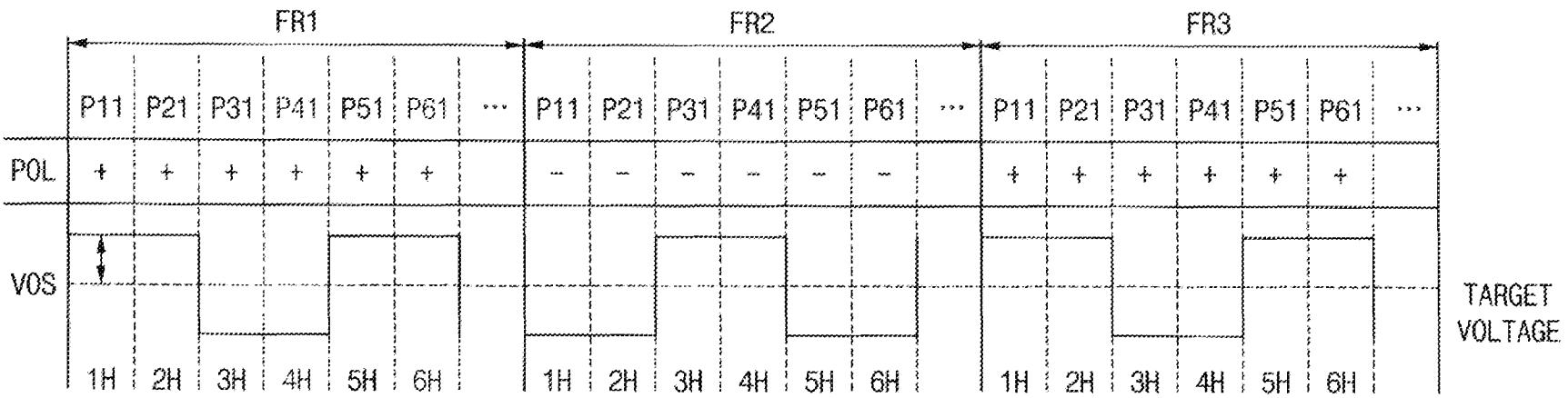
FIG. 11 is a conceptual diagram illustrating an output voltage of a gamma amplifier of the display apparatus of FIG. 10 when a polarity of the offset voltage of the gamma amplifier is inverted in a unit of a frame and in a unit of two horizontal lines.
Figure 12:
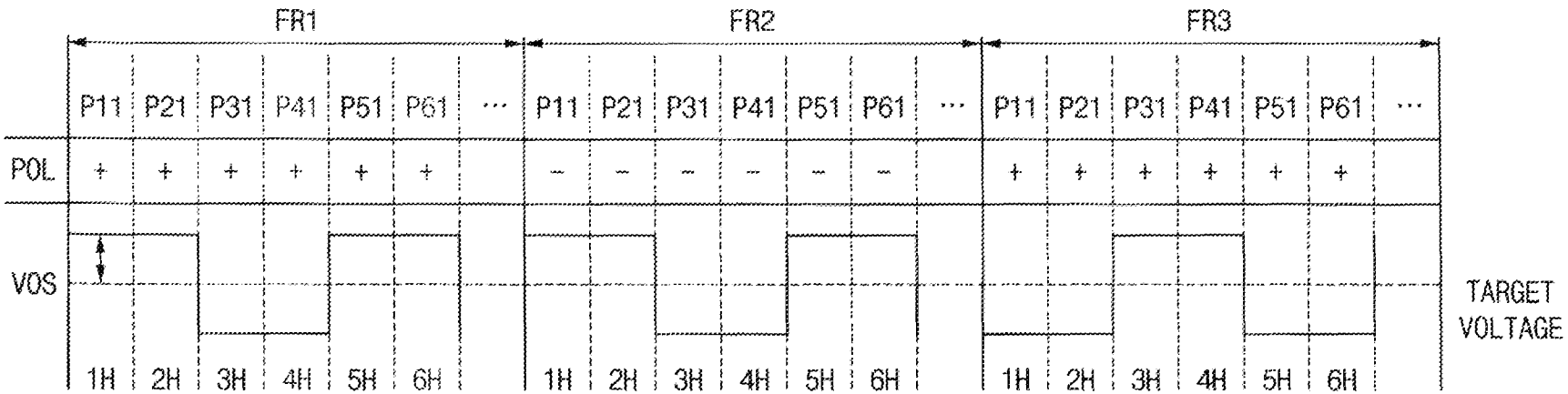
FIG. 12 is a conceptual diagram illustrating an output voltage of the gamma amplifier of the display apparatus of FIG. 10 when a polarity of the offset voltage of the gamma amplifier is inverted in a unit of two frames and in a unit of two horizontal lines.
Figure 13:
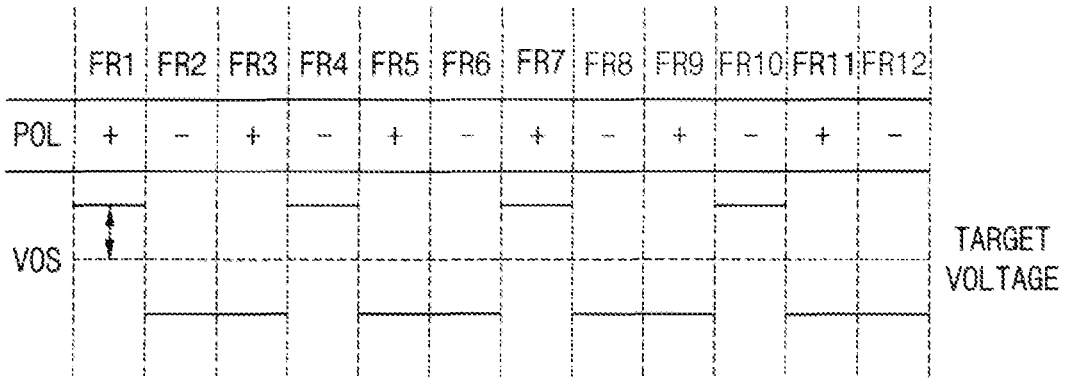
FIG. 13 is a conceptual diagram illustrating an output voltage of the gamma amplifier of the display apparatus of FIG. 10 when a polarity of the offset voltage of the gamma amplifier is inverted in a unit of one frame, two frames, one frame and two frames sequentially.

FIG. 10 is a conceptual diagram illustrating a display panel 100 of a display apparatus according to an embodiment. FIG. 11 is a conceptual diagram illustrating an output voltage of a gamma amplifier GA of the display apparatus of FIG. 10 when a polarity of the offset voltage VOS of the gamma amplifier GA is inverted in a unit of a frame and in a unit of two horizontal lines. FIG. 12 is a conceptual diagram illustrating an output voltage of the gamma amplifier GA of the display apparatus of FIG. 10 when a polarity of the offset voltage VOS of the gamma amplifier GA is inverted in a unit of two frames and in a unit of two horizontal lines. FIG. 13 is a conceptual diagram illustrating an output voltage of the gamma amplifier GA of the display apparatus of FIG. 10 when a polarity of the offset voltage VOS of the gamma amplifier GA is inverted in a unit of one frame, two frames, one frame and two frames sequentially.

The display apparatus and the method of the display apparatus according to the embodiment described herein is substantially the same as the display apparatus and the method of the display apparatus of the previous embodiment explained referring to FIGS. 1 to 8 except for a pixel structure of a display panel 100 and an inversion sequence pattern of the offset voltage VOS of the gamma amplifier GA. Thus, the same reference numerals will be used to refer to the same or like parts as those described in the previous embodiment of FIGS. 1 to 8 and any repetitive explanation concerning the above elements will be omitted for ease in explanation of this embodiment.

Referring to FIGS. 1 and 10 to 13, one data line may be connected to pixels in one pixel column in the display panel 100 as shown in FIG. 10. In addition, one gate line may be connected to pixels in one pixel row in the display panel 100 as shown in FIG. 10.

For example, the pixels in a first pixel column P11, P21, P31, P41, P51 and P61 may be connected to a first data line DL1. For example, the pixels in a second pixel column P12, P22, P32, P42, P52 and P62 may be connected to a second data line DL2. For example, the pixels in a third pixel column P13, P23, P33, P43, P53 and P63 may be connected to a third data line DL3.

For example, the pixels in a first pixel row P11 to P16 may be connected to a first gate line GL1. For example, pixels P21 to P26 in a second pixel row may be connected to a second gate line GL2. For example, pixels P31 to P36 in a third pixel row may be connected to a third gate line GL3. For example, pixels P41 to P46 in a fourth pixel row may be connected to a fourth gate line GL4. For example, pixels P51 to P56 in a fifth pixel row may be connected to a fifth gate line GL5. For example, pixels P61 to P66 in a sixth pixel row may be connected to a sixth gate line GL6.

Data voltages applied to adjacent data lines may have opposite polarities. In addition, the polarities of the data voltages applied to the data lines may be inverted in a unit of a frame. For example, positive data voltages may be applied to the first, third and fifth data lines DL1, DL3 and DL5 in a first frame. For example, negative data voltages may be applied to the second, fourth and sixth data lines DL2, DL4 and DL6 in the first frame. For example, negative data voltages may be applied to the first, third and fifth data lines DL1, DL3 and DL5 in a second frame. For example, positive data voltages may be applied to the second, fourth and sixth data lines DL2, DL4 and DL6 in the second frame.

Accordingly, the data voltages applied to the pixels of the display panel 100 may be inverted in every pixel column.

As shown in FIG. 11, the offset voltage VOS of the gamma amplifier GA may be inverted in a unit of two horizontal lines. In addition, the offset voltage VOS of the gamma amplifier GA may be inverted in a unit of one frame. Accordingly, the positive offset voltage +VOS of the pixel of P11 may be spatially canceled by the negative offset voltage −VOS of the pixel of P31 in the first frame FR1. Similarly, the positive offset voltage +VOS of the pixel of P21 may be spatially canceled by the negative offset voltage −VOS of the pixel of P41 in the first frame FR1.

However, when the polarity of the data voltage is inverted in a unit of one frame and the polarity of the offset voltage VOS of the gamma amplifier GA is inverted in a unit of one frame, the polarity of the data voltage applied to the pixel of P11 in the first horizontal line period 1H of the first frame FR1 may be positive + and the polarity of the offset voltage VOS of the gamma amplifier GA applied to the pixel of P11 in the first horizontal line period 1H of the first frame FR1 may be positive +VOS and the polarity of the data voltage applied to the pixel of P11 in the first horizontal line period 1H of the third frame FR3 may be positive + and the polarity of the offset voltage VOS of the gamma amplifier GA applied to the pixel of P11 in the first horizontal line period 1H of the third frame FR3 may be positive +VOS. Thus, the temporal cancelation of the offset voltage VOS of the gamma amplifier GA for the pixel of P11 may not be performed between the first frame FR1 when the data voltage having the positive polarity and the third frame FR3 when the data voltage having the positive polarity.

As shown in FIG. 12, when the offset voltage VOS of the gamma amplifier GA is inverted in a unit of two horizontal lines, the positive offset voltage +VOS of the pixel of P11 may be properly canceled by the negative offset voltage −VOS of the pixel of P31 as explained referring to FIG. 11.

In FIG. 11, the polarity of the data voltage is inverted in a unit of one frame and the polarity of the offset voltage VOS of the gamma amplifier GA is inverted in a unit of one frame so that the temporal cancelation of the offset voltage VOS of the gamma amplifier GA may not be performed between the first frame FR1 when the data voltage having the positive polarity and the third frame FR3 when the data voltage having the positive polarity.

However, in FIG. 12, the polarity of the data voltage is inverted in a unit of one frame and the polarity of the offset voltage VOS of the gamma amplifier GA is inverted in a unit of two frames so that the temporal cancelation of the offset voltage VOS of the gamma amplifier GA may be properly performed between the first frame FR1 when the data voltage having the positive polarity and the third frame FR3 when the data voltage having the positive polarity.

However, when the polarity of the data voltage is inverted in a unit of two frames, the driving frequency of the display panel 100 may be reduced by half in a view of the gamma reference voltage VGREF. When the polarity of the data voltage is inverted in a unit of two frames and the display panel 100 maintains the same image, a flicker effect may be shown to a user due to the reduced driving frequency.

In an embodiment, the inversion of the polarity of the offset voltage VOS of the gamma amplifier GA in a unit of one frame and the inversion of the polarity of the offset voltage VOS of the gamma amplifier GA in a unit of two frames may be alternately performed.

In FIG. 13, the polarity of the data voltage is inverted in a unit of one frame so that the polarities of the data voltage in first to sixth frames FR1 to FR6 may be sequentially +, −, +, −, + and −.

The polarity of the offset voltage VOS of the gamma amplifier GA may be inverted in a unit of one frame from a first frame FR1 to a second frame FR2, may be inverted in a unit of two frames from the second frame FR2 to a fourth frame FR4, may be inverted in a unit of one frame from the fourth frame FR4 to a fifth frame FR5 and may be inverted in a unit of two frames from the fifth frame FR5 to a seventh frame FR7. Thus, the polarities of the offset voltage VOS of the gamma amplifier GA in first to sixth frames FR1 to FR6 may be sequentially +, −, −, +, − and −. The polarities of the offset voltage VOS of the gamma amplifier GA in seventh to twelfth frames FR7 to FR12 may be also sequentially +, −, −, +, − and −.

The polarities of the offset voltage VOS of the gamma amplifier GA may be sequentially +, − and − in the first, third and fifth frames FR1, FR3 and FR5 when the data voltage has the positive polarity. The polarities of the offset voltage VOS of the gamma amplifier GA may be sequentially −, + and − in the second, fourth and sixth frames FR2, FR4 and FR6 when the data voltage has the negative polarity.

Although the polarity inversion pattern of the offset voltage VOS of the gamma amplifier GA of FIG. 13 is applied to the display panel 100 in the embodiment, the inventive concept may not be limited thereto. Alternatively, the polarity inversion pattern of the offset voltage VOS of the gamma amplifier GA of FIG. 9 may be applied to the display panel 100. When the polarity inversion pattern of the offset voltage VOS of the gamma amplifier GA of FIG. 9 is applied to the display panel 100, the polarity inversion pattern of the offset voltage VOS may be inverted in a unit of two horizontal lines and the polarity of the offset voltage VOS of the gamma amplifier GA may be inverted in a unit of one frame from a first frame FR1 to a second frame FR2, may be inverted in a unit of two frames from the second frame FR2 to a fourth frame FR4, may be inverted in a unit of two frames from the fourth frame FR4 to a sixth frame FR6 and may be inverted in a unit of one frame from the sixth frame FR6 to a seventh frame FR7.

According to one or more embodiments described herein, the polarity of the offset voltage VOS of the gamma amplifier GA may be inverted alternately in a unit of one frame and in a unit of two frames. Thus, no offset voltage cancelation problem occurs in a temporal manner when the polarity of the offset voltage VOS of the gamma amplifier GA is inverted in a unit of one frame, and no flicker effect is generated in a displayed image when the polarity of the offset voltage of the gamma amplifier is inverted in a unit of two frames.

In addition, the polarity of the offset voltage VOS of the gamma amplifier GA is inverted in a unit of two horizontal lines in a pixel structure including one data line connected to pixels disposed in one pixel column so that the offset voltage VOS of the gamma amplifier GA may be spatially compensated.

The offset voltage of the gamma amplifier may be temporally and spatially compensated properly so that the display quality of the display panel 100 may be enhanced.

Figure 14:
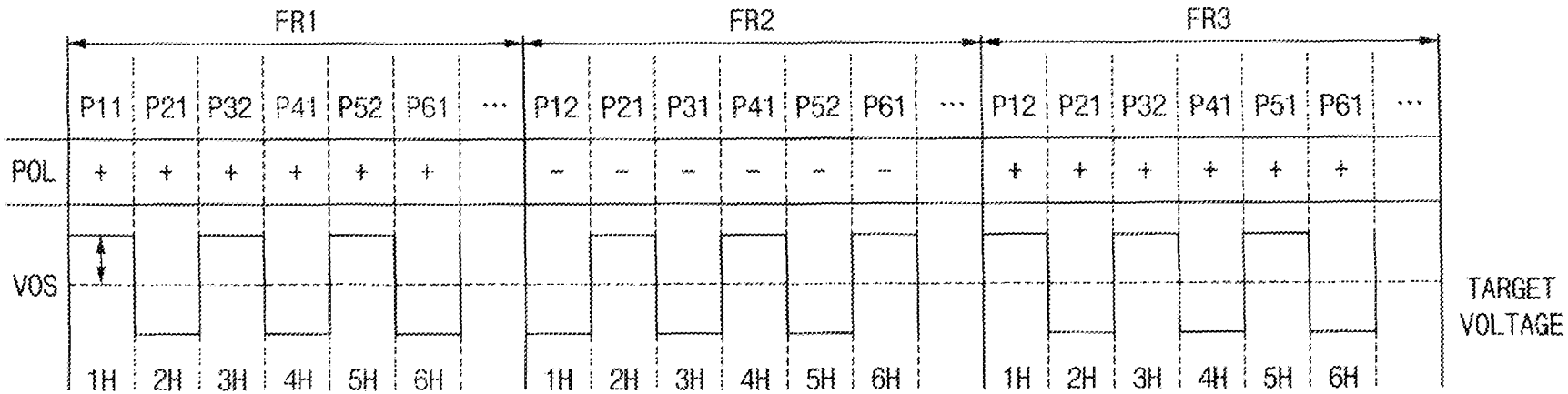
FIG. 14 is a conceptual diagram illustrating an output voltage of a gamma amplifier of a display apparatus of according to an embodiment when a polarity of an offset voltage of the gamma amplifier is inverted in a unit of a frame and in a unit of a horizontal line.
Figure 15:
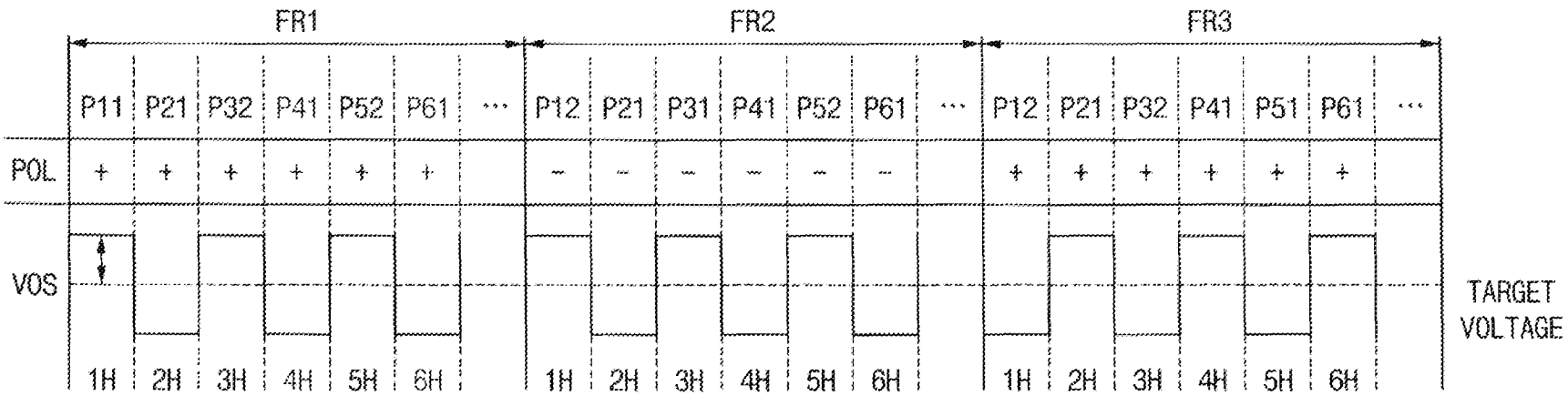
FIG. 15 is a conceptual diagram illustrating an output voltage of the gamma amplifier of the display apparatus of FIG. 14 when a polarity of the offset voltage of the gamma amplifier is inverted in a unit of two frames and in a unit of a horizontal line.

FIG. 14 is a conceptual diagram illustrating an output voltage of a gamma amplifier GA of a display apparatus of according to an embodiment when a polarity of an offset voltage VOS of the gamma amplifier GA is inverted in a unit of a frame and in a unit of a horizontal line. FIG. 15 is a conceptual diagram illustrating an output voltage of the gamma amplifier GA of the display apparatus of FIG. 14 when a polarity of the offset voltage VOS of the gamma amplifier GA is inverted in a unit of two frames and in a unit of a horizontal line.

The display apparatus and the method of the display apparatus according to the embodiment described herein is substantially the same as the display apparatus and the method of the display apparatus of the previous embodiment explained referring to FIGS. 10 to 13 except for an inversion sequence pattern of the offset voltage VOS of the gamma amplifier GA. Thus, the same reference numerals will be used to refer to the same or like parts as those described in the previous embodiment of FIGS. 10 to 13 and any repetitive explanation concerning the above elements will be omitted for ease in explanation of this embodiment.

Referring to FIGS. 1, 10 and 13 to 15, one data line may be connected to pixels in one pixel column in the display panel 100 as shown in FIG. 10. In addition, one gate line may be connected to pixels in one pixel row in the display panel 100 as shown in FIG. 10.

As shown in FIG. 14, the offset voltage VOS of the gamma amplifier GA may be inverted in a unit of one horizontal line. In addition, the offset voltage VOS of the gamma amplifier GA may be inverted in a unit of one frame. Accordingly, the positive offset voltage +VOS of the pixel of P11 may be spatially canceled by the negative offset voltage −VOS of the pixel of P21 in the first frame FR1. Similarly, the positive offset voltage +VOS of the pixel of P31 may be spatially canceled by the negative offset voltage −VOS of the pixel of P41 in the first frame FR1.

However, when the polarity of the data voltage is inverted in a unit of one frame and the polarity of the offset voltage VOS of the gamma amplifier GA is inverted in a unit of one frame, the polarity of the data voltage applied to the pixel of P11 in the first horizontal line period 1H of the first frame FR1 may be positive + and the polarity of the offset voltage VOS of the gamma amplifier GA applied to the pixel of P11 in the first horizontal line period 1H of the first frame FR1 may be positive +VOS and the polarity of the data voltage applied to the pixel of P11 in the first horizontal line period 1H of the third frame FR3 may be positive + and the polarity of the offset voltage VOS of the gamma amplifier GA applied to the pixel of P11 in the first horizontal line period 1H of the third frame FR3 may be positive +VOS. Thus, the temporal cancelation of the offset voltage VOS of the gamma amplifier GA for the pixel of P11 may not be performed between the first frame FR1 when the data voltage having the positive polarity and the third frame FR3 when the data voltage having the positive polarity.

As shown in FIG. 15, when the offset voltage VOS of the gamma amplifier GA is inverted in a unit of two horizontal lines, the positive offset voltage +VOS of the pixel of P11 may be properly canceled by the negative offset voltage −VOS of the pixel of P21 as explained referring to FIG. 14.

In FIG. 14, the polarity of the data voltage is inverted in a unit of one frame and the polarity of the offset voltage VOS of the gamma amplifier GA is inverted in a unit of one frame so that the temporal cancelation of the offset voltage VOS of the gamma amplifier GA may not be performed between the first frame FR1 when the data voltage having the positive polarity and the third frame FR3 when the data voltage having the positive polarity.

However, in FIG. 15, the polarity of the data voltage is inverted in a unit of one frame and the polarity of the offset voltage VOS of the gamma amplifier GA is inverted in a unit of two frames so that the temporal cancelation of the offset voltage VOS of the gamma amplifier GA may be properly performed between the first frame FR1 when the data voltage having the positive polarity and the third frame FR3 when the data voltage having the positive polarity.

However, when the polarity of the data voltage is inverted in a unit of two frames, the driving frequency of the display panel 100 may be reduced by half in a view of the gamma reference voltage VGREF. When the polarity of the data voltage is inverted in a unit of two frames and the display panel 100 maintains the same image, a flicker effect may be shown to a user due to the reduced driving frequency.

In an embodiment, the inversion of the polarity of the offset voltage VOS of the gamma amplifier GA in a unit of one frame and the inversion of the polarity of the offset voltage VOS of the gamma amplifier GA in a unit of two frames may be alternately performed.

In FIG. 13, the polarity of the data voltage is inverted in a unit of one frame so that the polarities of the data voltage in first to sixth frames FR1 to FR6 may be sequentially +, −, +, −, + and −.

The polarity of the offset voltage VOS of the gamma amplifier GA may be inverted in a unit of one frame from a first frame FR1 to a second frame FR2, may be inverted in a unit of two frames from the second frame FR2 to a fourth frame FR4, may be inverted in a unit of one frame from the fourth frame FR4 to a fifth frame FR5 and may be inverted in a unit of two frames from the fifth frame FR5 to a seventh frame FR7. Thus, the polarities of the offset voltage VOS of the gamma amplifier GA in first to sixth frames FR1 to FR6 may be sequentially +, −, −, +, − and −. The polarities of the offset voltage VOS of the gamma amplifier GA in seventh to twelfth frames FR7 to FR12 may be also sequentially +, −, −, +, − and −.

The polarities of the offset voltage VOS of the gamma amplifier GA may be sequentially +, − and − in the first, third and fifth frames FR1, FR3 and FR5 when the data voltage has the positive polarity. The polarities of the offset voltage VOS of the gamma amplifier GA may be sequentially −, + and − in the second, fourth and sixth frames FR2, FR4 and FR6 when the data voltage has the negative polarity.

Although the polarity inversion pattern of the offset voltage VOS of the gamma amplifier GA of FIG. 13 is applied to the display panel 100 in the present embodiment, the inventive concept may not be limited thereto. Alternatively, the polarity inversion pattern of the offset voltage VOS of the gamma amplifier GA of FIG. 9 may be applied to the display panel 100. When the polarity inversion pattern of the offset voltage VOS of the gamma amplifier GA of FIG. 9 is applied to the display panel 100, the polarity inversion pattern of the offset voltage VOS may be inverted in a unit of two horizontal lines and the polarity of the offset voltage VOS of the gamma amplifier GA may be inverted in a unit of one frame from a first frame FR1 to a second frame FR2, may be inverted in a unit of two frames from the second frame FR2 to a fourth frame FR4, may be inverted in a unit of two frames from the fourth frame FR4 to a sixth frame FR6 and may be inverted in a unit of one frame from the sixth frame FR6 to a seventh frame FR7.

According to the embodiment described herein, the polarity of the offset voltage VOS of the gamma amplifier GA may be inverted alternately in a unit of one frame and in a unit of two frames. Thus, no offset voltage cancelation problem occurs in a temporal manner when the polarity of the offset voltage VOS of the gamma amplifier GA is inverted in a unit of one frame, and no flicker problem occurs in a display imaged when the polarity of the offset voltage of the gamma amplifier is inverted in a unit of two frames.

In addition, the polarity of the offset voltage VOS of the gamma amplifier GA is inverted in a unit of two horizontal lines in a pixel structure including one data line connected to pixels disposed in one pixel column so that the offset voltage VOS of the gamma amplifier GA may be spatially compensated.

The offset voltage of the gamma amplifier may be temporally and spatially compensated properly so that the display quality of the display panel 100 may be enhanced.

Figure 16:
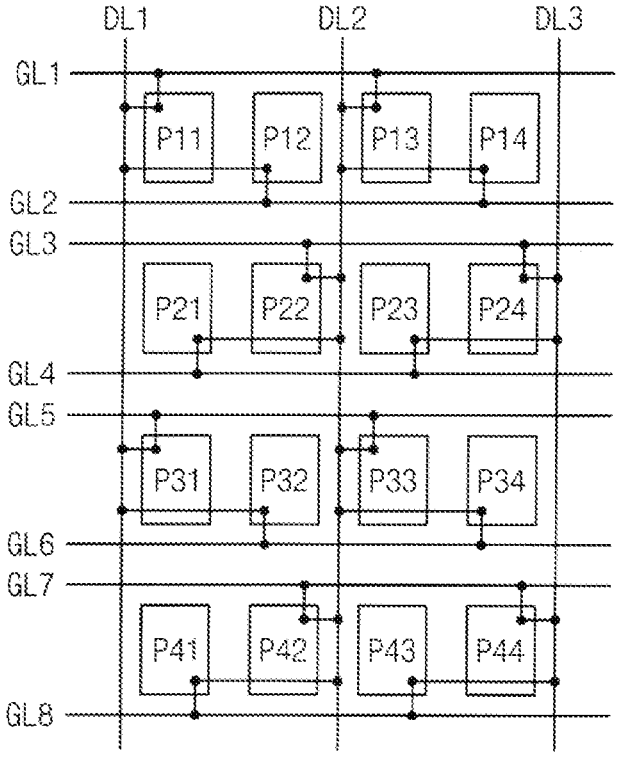
FIG. 16 is a conceptual diagram illustrating a display panel of a display apparatus according to an embodiment.
Figure 17:
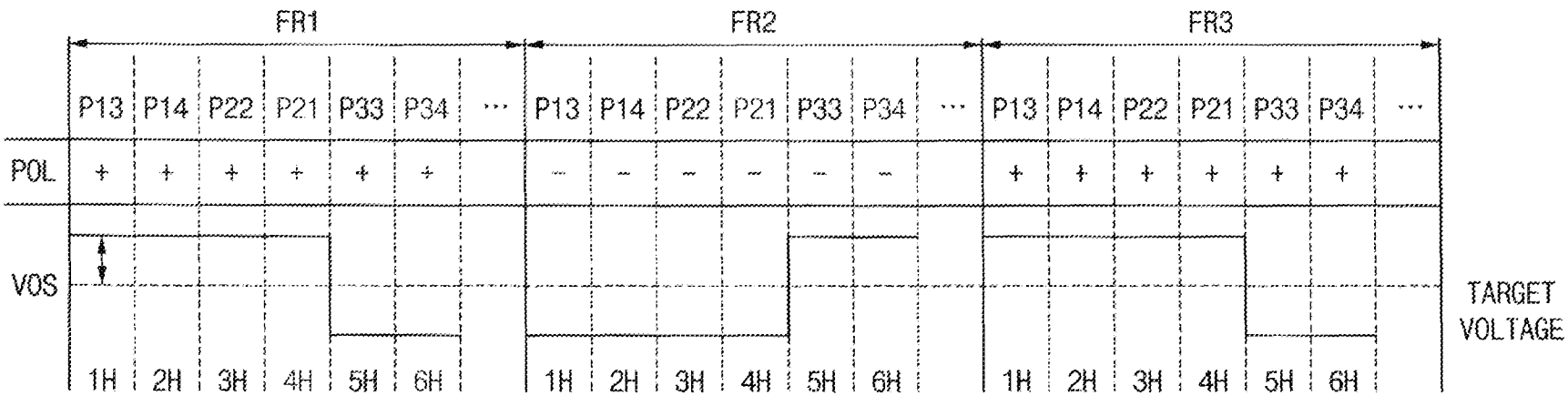
FIG. 17 is a conceptual diagram illustrating an output voltage of a gamma amplifier of the display apparatus of FIG. 16 when a polarity of the offset voltage of the gamma amplifier is inverted in a unit of a frame and in a unit of four horizontal lines.
Figure 18:
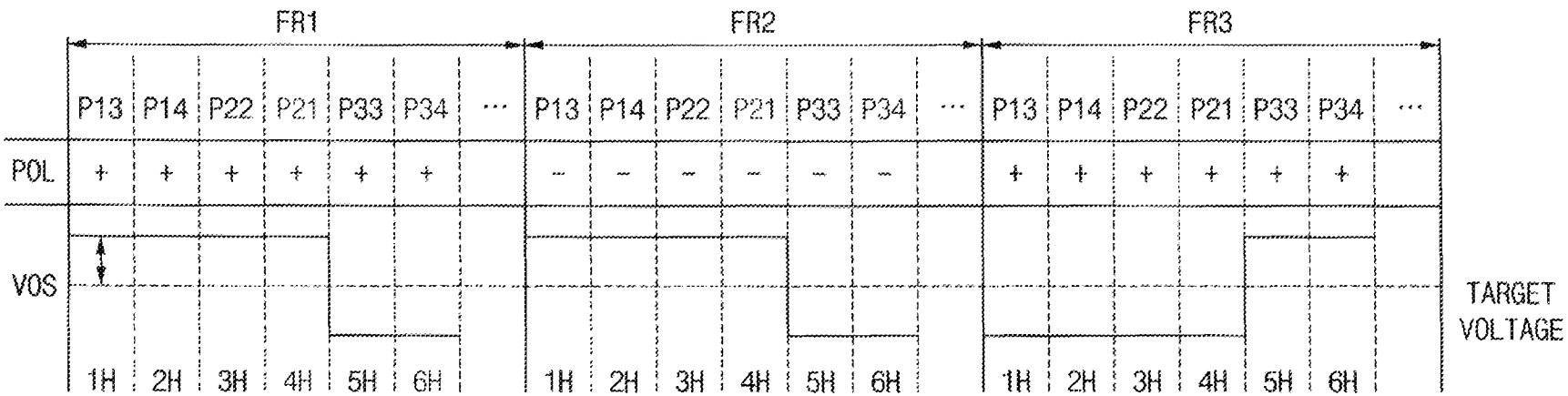
FIG. 18 is a conceptual diagram illustrating an output voltage of the gamma amplifier of the display apparatus of FIG. 16 when a polarity of the offset voltage of the gamma amplifier is inverted in a unit of two frames and in a unit of four horizontal lines.
Figure 19:
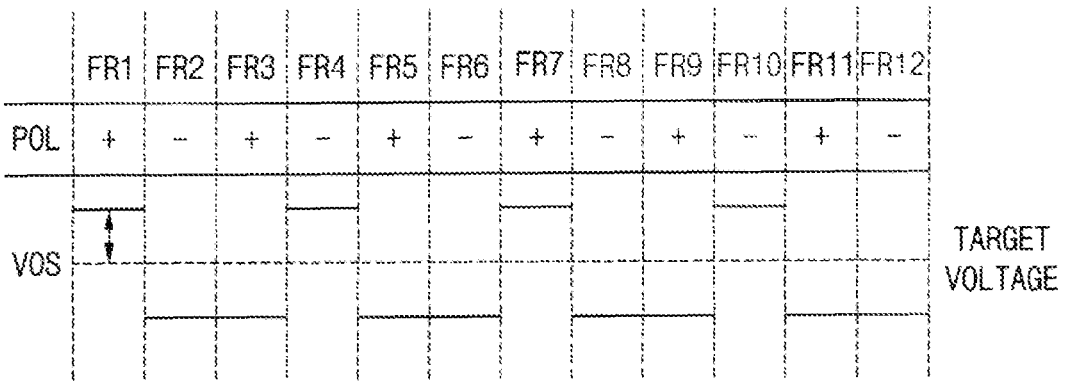
FIG. 19 is a conceptual diagram illustrating an output voltage of the gamma amplifier of the display apparatus of FIG. 16 when a polarity of the offset voltage of the gamma amplifier is inverted in a unit of one frame, two frames, one frame and two frames sequentially.

FIG. 16 is a conceptual diagram illustrating a display panel of a display apparatus according to an embodiment. FIG. 17 is a conceptual diagram illustrating an output voltage of a gamma amplifier of the display apparatus of FIG. 16 when a polarity of the offset voltage of the gamma amplifier is inverted in a unit of a frame and in a unit of four horizontal lines. FIG. 18 is a conceptual diagram illustrating an output voltage of the gamma amplifier of the display apparatus of FIG. 16 when a polarity of the offset voltage of the gamma amplifier is inverted in a unit of two frames and in a unit of four horizontal lines. FIG. 19 is a conceptual diagram illustrating an output voltage of the gamma amplifier of the display apparatus of FIG. 16 when a polarity of the offset voltage of the gamma amplifier is inverted in a unit of one frame, two frames, one frame and two frames sequentially.

The display apparatus and the method of the display apparatus according to the embodiment described herein is substantially the same as the display apparatus and the method of the display apparatus of the previous embodiment explained referring to FIGS. 1 to 8 except for a pixel structure of a display panel 100 and an inversion sequence pattern of the offset voltage VOS of the gamma amplifier GA. Thus, the same reference numerals will be used to refer to the same or like parts as those described in the embodiment of FIGS. 1 to 8 and any repetitive explanation concerning the above elements will be omitted for ease in explanation of this embodiment.

Referring to FIGS. 1 and 16 to 19, one data line may be alternately connected to pixels in four pixel column in the display panel 100 as shown in FIG. 16. In addition, two gate lines may be connected to pixels in one pixel row in the display panel 100 as shown in FIG. 16.

For example, a first data line DL1 may be connected to a first pixel P11 and a second pixel P12 in a first pixel row and a first pixel P31 and a second pixel P32 in a third pixel row. For example, a second data line DL2 may be connected to a third pixel P13 and a fourth pixel P14 in the first pixel row, a first pixel P21 and a second pixel P22 in a second pixel row, a third pixel P33 and a fourth pixel P34 in the third pixel row and a first pixel P41 and a second pixel P42 in a fourth pixel row. For example, a third data line DL3 may be connected to a third pixel P23 and a fourth pixel P24 in the second pixel row and a third pixel P43 and a fourth pixel P44 in the fourth pixel row.

For example, a first gate line GL1 may be connected to the first pixel P11 and the third pixel P13 in the first pixel row. For example, a second gate line GL2 may be connected to the second pixel P12 and the fourth pixel P14 in the first pixel row. For example, a third gate line GL3 may be connected to the second pixel P22 and the fourth pixel P24 in the second pixel row. For example, a fourth gate line GL4 may be connected to the first pixel P21 and the third pixel P23 in the second pixel row.

As shown in FIG. 17, the offset voltage VOS of the gamma amplifier GA may be inverted in a unit of four horizontal lines. In addition, the offset voltage VOS of the gamma amplifier GA may be inverted in a unit of one frame.

Accordingly, the positive offset voltage +VOS of the pixel of P13 may be spatially canceled by the negative offset voltage −VOS of the pixel of P33 in the first frame FR1. Similarly, the positive offset voltage +VOS of the pixel of P14 may be spatially canceled by the negative offset voltage −VOS of the pixel of P34 in the first frame FR1.

However, when the polarity of the data voltage is inverted in a unit of one frame and the polarity of the offset voltage VOS of the gamma amplifier GA is inverted in a unit of one frame, the polarity of the data voltage applied to the pixel of P13 in the first horizontal line period 1H of the first frame FR1 may be positive + and the polarity of the offset voltage VOS of the gamma amplifier GA applied to the pixel of P13 in the first horizontal line period 1H of the first frame FR1 may be positive +VOS and the polarity of the data voltage applied to the pixel of P13 in the first horizontal line period 1H of the third frame FR3 may be positive + and the polarity of the offset voltage VOS of the gamma amplifier GA applied to the pixel of P13 in the first horizontal line period 1H of the third frame FR3 may be positive +VOS. Thus, the temporal cancelation of the offset voltage VOS of the gamma amplifier GA for the pixel of P13 may not be performed between the first frame FR1 when the data voltage having the positive polarity and the third frame FR3 when the data voltage having the positive polarity.

As shown in FIG. 18, when the offset voltage VOS of the gamma amplifier GA is inverted in a unit of four horizontal lines, the positive offset voltage +VOS of the pixel of P13 may be properly canceled by the negative offset voltage −VOS of the pixel of P33 as explained referring to FIG. 11.

In FIG. 17, the polarity of the data voltage is inverted in a unit of one frame and the polarity of the offset voltage VOS of the gamma amplifier GA is inverted in a unit of one frame so that the temporal cancelation of the offset voltage VOS of the gamma amplifier GA may not be performed between the first frame FR1 when the data voltage having the positive polarity and the third frame FR3 when the data voltage having the positive polarity.

However, in FIG. 18, the polarity of the data voltage is inverted in a unit of one frame and the polarity of the offset voltage VOS of the gamma amplifier GA is inverted in a unit of two frames so that the temporal cancelation of the offset voltage VOS of the gamma amplifier GA may be properly performed between the first frame FR1 when the data voltage having the positive polarity and the third frame FR3 when the data voltage having the positive polarity.

However, when the polarity of the data voltage is inverted in a unit of two frames, the driving frequency of the display panel 100 may be reduced by half in a view of the gamma reference voltage VGREF. When the polarity of the data voltage is inverted in a unit of two frames and the display panel 100 maintains the same image, a flicker may be shown to a user due to the reduced driving frequency.

In an embodiment as described herein, the inversion of the polarity of the offset voltage VOS of the gamma amplifier GA in a unit of one frame and the inversion of the polarity of the offset voltage VOS of the gamma amplifier GA in a unit of two frames may be alternately performed.

In FIG. 19, the polarity of the data voltage is inverted in a unit of one frame so that the polarities of the data voltage in first to sixth frames FR1 to FR6 may be sequentially +, −, +, −, + and −.

The polarity of the offset voltage VOS of the gamma amplifier GA may be inverted in a unit of one frame from a first frame FR1 to a second frame FR2, may be inverted in a unit of two frames from the second frame FR2 to a fourth frame FR4, may be inverted in a unit of one frame from the fourth frame FR4 to a fifth frame FR5 and may be inverted in a unit of two frames from the fifth frame FR5 to a seventh frame FR7. Thus, the polarities of the offset voltage VOS of the gamma amplifier GA in first to sixth frames FR1 to FR6 may be sequentially +, −, −, +, − and −. The polarities of the offset voltage VOS of the gamma amplifier GA in seventh to twelfth frames FR7 to FR12 may be also sequentially +, −, −, +, − and −.

The polarities of the offset voltage VOS of the gamma amplifier GA may be sequentially +, − and − in the first, third and fifth frames FR1, FR3 and FR5 when the data voltage has the positive polarity. The polarities of the offset voltage VOS of the gamma amplifier GA may be sequentially −, + and − in the second, fourth and sixth frames FR2, FR4 and FR6 when the data voltage has the negative polarity.

Although the polarity inversion pattern of the offset voltage VOS of the gamma amplifier GA of FIG. 19 is applied to the display panel 100 in the embodiment, the inventive concept may not be limited thereto. Alternatively, the polarity inversion pattern of the offset voltage VOS of the gamma amplifier GA of FIG. 9 may be applied to the display panel 100. When the polarity inversion pattern of the offset voltage VOS of the gamma amplifier GA of FIG. 9 is applied to the display panel 100, the polarity inversion pattern of the offset voltage VOS may be inverted in a unit of four horizontal lines and the polarity of the offset voltage VOS of the gamma amplifier GA may be inverted in a unit of one frame from a first frame FR1 to a second frame FR2, may be inverted in a unit of two frames from the second frame FR2 to a fourth frame FR4, may be inverted in a unit of two frames from the fourth frame FR4 to a sixth frame FR6 and may be inverted in a unit of one frame from the sixth frame FR6 to a seventh frame FR7.

According to the embodiment described herein, the polarity of the offset voltage VOS of the gamma amplifier GA may be inverted alternately in a unit of one frame and in a unit of two frames. Thus, no offset voltage cancelation problem occurs in a temporal manner when the polarity of the offset voltage VOS of the gamma amplifier GA is inverted in a unit of one frame, and no flicker problem is generated in a displayed image when the polarity of the offset voltage of the gamma amplifier is inverted in a unit of two frames.

In addition, the polarity of the offset voltage VOS of the gamma amplifier GA is inverted in a unit of four horizontal lines in a pixel structure including one data line connected to pixels disposed in four pixel columns so that the offset voltage VOS of the gamma amplifier GA may be spatially compensated.

The offset voltage of the gamma amplifier may be temporally and spatially compensated properly so that the display quality of the display panel 100 may be enhanced. According to the display apparatus and the method of driving the display apparatus according to one or more embodiments as explained above, the offset voltage of the gamma amplifier may be temporally and spatially compensated properly so that the display quality of the display panel may be enhanced.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display apparatus comprising:

a display panel;

a gamma reference voltage generator configured to generate a gamma reference voltage and including a gamma amplifier configured to output the gamma reference voltage; and a data driver configured to generate a data voltage based on the gamma reference voltage and to output the data voltage to the display panel, wherein a polarity of an offset voltage of the gamma amplifier is inverted alternately in a unit of one frame and in a unit of two frames such that the polarity of the offset voltage of the gamma amplifier is inverted in the unit of one frame in a first time period, and the polarity of the offset voltage of the gamma amplifier is inverted in the unit of two frames in a second time period different from the first time period.

2. The display apparatus of claim 1, wherein a polarity of the data voltage is inverted in a unit of one frame.

3. The display apparatus of claim 2, wherein the offset voltage of the gamma amplifier has a first polarity in a first frame, a second polarity in a second frame, the second polarity in a third frame, the first polarity in a fourth frame, the second polarity in a fifth frame, the second polarity in a sixth frame and the first polarity in a seventh frame, wherein the second polarity is different from the first polarity.

4. The display apparatus of claim 2, wherein the offset voltage of the gamma amplifier has a first polarity in a first frame, a second polarity in a second frame, the second polarity in a third frame, the first polarity in a fourth frame, the first polarity in a fifth frame, the second polarity in a sixth frame and the first polarity in a seventh frame, wherein the second polarity is different from the first polarity.

5. The display apparatus of claim 2, wherein one frame inversion of the polarity of the offset voltage and two frame inversion of the polarity of the offset voltage are randomly performed over a plurality of frames.

6. The display apparatus of claim 1, wherein one data line is alternately connected to pixels disposed in two pixel columns in the display panel.

7. The display apparatus of claim 6, wherein the polarity of the offset voltage of the gamma amplifier is inverted in a unit of two horizontal lines, and the polarity of the offset voltage of the gamma amplifier is inverted alternately in a unit of one frame and in a unit of two frames.

8. The display apparatus of claim 7, wherein the polarity of the offset voltage of the gamma amplifier is inverted in a unit of two horizontal lines, and the offset voltage of the gamma amplifier has a first polarity in a first frame, a second polarity in a second frame, the second polarity in a third frame, the first polarity in a fourth frame, the first polarity in a fifth frame, the second polarity in a sixth frame and the first polarity in a seventh frame, wherein the second polarity is different from the first polarity.

9. The display apparatus of claim 1, wherein one data line is connected to pixels disposed in one pixel column in the display panel.

10. The display apparatus of claim 9, wherein the polarity of the offset voltage of the gamma amplifier is inverted in a unit of two horizontal lines, and the polarity of the offset voltage of the gamma amplifier is inverted alternately in a unit of one frame and in a unit of two frames.

11. The display apparatus of claim 10, wherein the polarity of the offset voltage of the gamma amplifier is inverted in a unit of two horizontal lines, and the offset voltage of the gamma amplifier has a first polarity in a first frame, a second polarity in a second frame, the second polarity in a third frame, the first polarity in a fourth frame, the first polarity in a fifth frame, the second polarity in a sixth frame and the first polarity in a seventh frame, wherein the second polarity is different from the first polarity.

12. The display apparatus of claim 9, wherein the polarity of the offset voltage of the gamma amplifier is inverted in a unit of one horizontal line, and the polarity of the offset voltage of the gamma amplifier is inverted alternately in a unit of one frame and in a unit of two frames.

13. The display apparatus of claim 12, wherein the polarity of the offset voltage of the gamma amplifier is inverted in a unit of one horizontal line, and the offset voltage of the gamma amplifier has a first polarity in a first frame, a second polarity in a second frame, the second polarity in a third frame, the first polarity in a fourth frame, the first polarity in a fifth frame, the second polarity in a sixth frame and the first polarity in a seventh frame, wherein the second polarity is different from the first polarity.

14. A display apparatus comprising:

a display panel;

a gamma reference voltage generator configured to generate a gamma reference voltage and including a gamma amplifier configured to output the gamma reference voltage; and a data driver configured to generate a data voltage based on the gamma reference voltage and to output the data voltage to the display panel, wherein a polarity of an offset voltage of the gamma amplifier is inverted alternately in a unit of one frame and in a unit of two frames, wherein one data line is alternately connected to pixels disposed in four pixel columns in the display panel.

15. The display apparatus of claim 14, wherein the polarity of the offset voltage of the gamma amplifier is inverted in a unit of four horizontal lines, and the polarity of the offset voltage of the gamma amplifier is inverted alternately in a unit of one frame and in a unit of two frames.

16. The display apparatus of claim 15, wherein the polarity of the offset voltage of the gamma amplifier is inverted in a unit of four horizontal lines, and the offset voltage of the gamma amplifier has a first polarity in a first frame, a second polarity in a second frame, the second polarity in a third frame, the first polarity in a fourth frame, the first polarity in a fifth frame, the second polarity in a sixth frame and the first polarity in a seventh frame, wherein the second polarity is different from the first polarity.

17. A method of driving a display apparatus, the method comprising:

generating a gamma reference voltage;

outputting, using a gamma amplifier, the gamma reference voltage to a data driver;

generating a data voltage based on the gamma reference voltage; and outputting the data voltage to a display panel, wherein a polarity of an offset voltage of the gamma amplifier is inverted alternately in a unit of one frame and in a unit of two frames such that the polarity of the offset voltage of the gamma amplifier is inverted in the unit of one frame in a first time period, and the polarity of the offset voltage of the gamma amplifier is inverted in the unit of two frames in a second time period different from the first time period.

18. The method of claim 17, wherein a polarity of the data voltage is inverted in a unit of one frame.

19. The method of claim 18, wherein the offset voltage of the gamma amplifier has a first polarity in a first frame, a second polarity in a second frame, the second polarity in a third frame, the first polarity in a fourth frame, the second polarity in a fifth frame, the second polarity in a sixth frame and the first polarity in a seventh frame, wherein the second polarity is different from the first polarity.

20. The method of claim 18, wherein the offset voltage of the gamma amplifier has a first polarity in a first frame, a second polarity in a second frame, the second polarity in a third frame, the first polarity in a fourth frame, the first polarity in a fifth frame, the second polarity in a sixth frame and the first polarity in a seventh frame, wherein the second polarity is different from the first polarity.

* * * * *